US011006195B2

(12) United States Patent
Worrell et al.

(10) Patent No.: US 11,006,195 B2
(45) **Date of Patent: *May 11, 2021**

(54) AUDIO SPEAKERS WITH INTEGRATED SEALING AND ASSEMBLY FEATURES FOR "CASELESS" INSTALLATION

(71) Applicant: INTEL CORPORATION, Santa Clara, CA (US)

(72) Inventors: Devon Worrell, Folsom, CA (US); David A. Rittenhouse, Fair Oaks, CA (US)

(73) Assignee: Intel Corporation, Santa Clara, CA (US)

( * ) Notice: Subject to any disclaimer, the term of this patent is extended or adjusted under 35 U.S.C. 154(b) by 287 days.

This patent is subject to a terminal disclaimer.

(21) Appl. No.: 15/605,951

(22) Filed: May 26, 2017

(65) Prior Publication Data

US 2017/0359640 A1 Dec. 14, 2017

Related U.S. Application Data

(62) Division of application No. 14/866,850, filed on Sep. 26, 2015.

(51) Int. Cl.
*H04R 1/02* (2006.01)
*H04R 1/28* (2006.01)
(Continued)

(52) U.S. Cl.
CPC ..... *H04R 1/026* (2013.01); *H04R 1/023* (2013.01); *H04R 1/025* (2013.01); *H04R 1/2807* (2013.01);
(Continued)

(58) Field of Classification Search
CPC ..... H04R 1/021; H04R 1/023; H04R 1/025; H04R 1/026; H04R 7/02; H04R 7/20;
(Continued)

(56) References Cited

U.S. PATENT DOCUMENTS 4,032,725 A * 6/1977 McGee ..... H04R 1/025 248/27.1
4,281,223 A 7/1981 Ugaji et al.
(Continued)

FOREIGN PATENT DOCUMENTS

WO 2007070025 A1 6/2007

OTHER PUBLICATIONS

International Search Report and Written Opinion dated Jan. 10, 2017, issued in related International Application No. PCT /US2016/051203, 9 pages.
(Continued)

*Primary Examiner* — Huyen D Le
(74) *Attorney, Agent, or Firm* — Schwabe, Williamson & Wyatt, P.C.

(57) ABSTRACT

Small-scale audio speakers of various shapes are installed in parent devices. Inner casings, and the surrounding vibration-damping zone often required between such casings and the surrounding parent-device walls, are omitted from the assembly. During integration with the parent device, each un-encased speaker and its signal lines are sealed into a single-walled enclosure that incorporates a parent-device wall as at least one side. The entire interior of the single-walled enclosure becomes a back volume for the speaker. The single-walled enclosure may incorporate seals at the speaker's audio-output aperture, at the pass-through for the signal lines, and at the interface between the parent-device wall(s) and the added side(s) constituting the single-walled enclosure. Optional adhesive-free sealing options include sliding tabs held by a snap-lock latch.

14 Claims, 11 Drawing Sheets

(51) Int. Cl.

| | |
|---|---|
| ***H04R 7/02*** | (2006.01) |
| ***H04R 31/00*** | (2006.01) |
| ***H04R 9/06*** | (2006.01) |
| *H04R 7/20* | (2006.01) |
| *H04R 7/14* | (2006.01) |

(52) U.S. Cl.
CPC ..... *H04R 1/2826* (2013.01); *H04R 1/2896* (2013.01); *H04R 7/02* (2013.01); *H04R 9/06* (2013.01); *H04R 31/006* (2013.01); *H04R 7/14* (2013.01); *H04R 7/20* (2013.01); *H04R 9/063* (2013.01); *H04R 2201/021* (2013.01); *H04R 2400/11* (2013.01); *H04R 2499/11* (2013.01); *H04R 2499/13* (2013.01); *H04R 2499/15* (2013.01)

(58) Field of Classification Search
CPC ..... H04R 31/006; H04R 2201/021; H04R 2400/11; H04R 2499/13; H04R 2499/15; H04R 1/2896; H04R 9/06; H04R 2499/11
USPC ... 381/86, 87, 353, 354, 386, 389, 391, 392, 381/395, 189, 398; 181/150, 171, 172, 181/199
See application file for complete search history.

(56) References Cited

U.S. PATENT DOCUMENTS

| | | | | |
|---|---|---|---|---|
| 4,433,214 | A * | 2/1984 | Jasinski | H04R 7/20 181/172 |
| 4,845,760 | A | 7/1989 | Awakowicz et al. | |
| 4,852,178 | A * | 7/1989 | Inkman | H04R 1/025 181/171 |
| 4,997,059 | A | 3/1991 | See et al. | |
| 5,689,574 | A * | 11/1997 | Heirich | G06F 1/1605 381/300 |
| 5,699,438 | A | 12/1997 | Smith et al. | |
| 5,867,583 | A | 2/1999 | Hazelwood et al. | |
| 6,526,150 | B2 | 2/2003 | Kelly et al. | |
| 6,752,366 | B2 * | 6/2004 | Chuang | H04R 1/025 248/220.21 |
| 6,760,460 | B1 | 7/2004 | Jeon et al. | |
| 6,876,753 | B2 * | 4/2005 | Kim | H04R 1/02 181/171 |
| 7,116,795 | B2 * | 10/2006 | Tuason | H04R 1/021 381/386 |
| 7,203,332 | B2 | 4/2007 | Hutt et al. | |
| 2002/0044671 | A1 | 4/2002 | Shimomura et al. | |
| 2003/0123679 | A1 | 7/2003 | Dudleston et al. | |
| 2014/0169606 | A1 | 6/2014 | Fleischman et al. | |
| 2014/0305734 | A1 | 10/2014 | Ivey et al. | |
| 2015/0003639 | A1 | 1/2015 | Cheung | |

OTHER PUBLICATIONS

Non-Final Office Action dated Mar. 9, 2017, issued in related U.S. Appl. No. 14/866,850, 9 pages.
Notice of Allowance dated Aug. 9, 2017, issued in related U.S. Appl. No. 14/866,850, 9 pages.
Notice of Allowance dated Aug. 14, 2017, issued in related U.S. Appl. No. 15/605,946, 9 pages.
Notice of Allowance dated Sep. 15, 2017, issued in related U.S. Appl. No. 15/605,946, 14 pages.

* cited by examiner

AUDIO SPEAKERS WITH INTEGRATED SEALING AND ASSEMBLY FEATURES FOR "CASELESS" INSTALLATION

RELATED APPLICATIONS

This application claims the benefit of priority from U.S. Non-Prov. patent application Ser. No. 14/866,850 filed Sep. 26, 2015 which is entirely incorporated by reference herein.

FIELD

Related fields include audio speakers, and more particularly miniature audio speakers built into a parent device such as a portable computer, telephone, earpiece, or hearing aid.

DETAILED DESCRIPTION

Figure 1A:
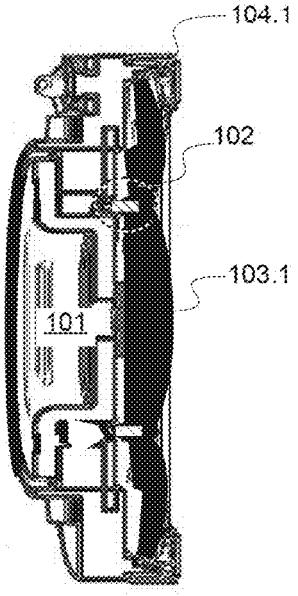
FIGS. 1A-1D illustrate a few examples of miniature speakers.

Dynamic audio speakers may be described as a series of transducers. An electrical input signal is converted by an electromagnet to a varying magnetic field. Variations in the magnetic field cause mechanical motion in a voice coil. The motion of the voice coil vibrates a cone, creating standing waves in a diaphragm stretched across the front of the cone. The vibrating diaphragm interacts with the surrounding medium (usually air) to create an acoustic output.

The back of the cone experiences mechanical perturbations 180° out of phase with those affecting the front. If the medium surrounding the cone is equally compressible in all directions, the front and back vibrations would tend to cancel each other out. Surrounding the back of the cone with a sealed cabinet, while leaving the air in front of the cone free to move, makes the air less compressible behind the speaker than in front of it. The less-compressible air inside the sealed cabinet (the "back volume") acts like a restoring spring opposing back vibration.

Additionally, if the cone were to be placed on a solid surface, the audible rattle or buzz resulting from the cone vibrating against the solid surface might compete with the sound resulting from the electrical input. To prevent this, cones may be mounted to a front wall or baffle to keep the back largely suspended and unable to vibrate against other solid surfaces. Preferably, the baffle is constructed to avoid resonance with the speaker.

Low frequencies are particularly affected by the out-of-phase vibration of the back of the speaker. These are also the frequencies that may benefit the most from a larger speaker diameter. Design of a dynamic speaker often involves a trade-off between user-perceptible variables such as output frequency range, output level, size and weight, and power handling.

Compared to sealed speakers where the back volume is ideally airtight, ported or vented speakers have openings, or ports in the back volume, Port parameters are selected to tune the speakers to particular frequencies. The port results in output from the back volume as well as the front. Near the selected frequency, the back output may exceed the front output: Leakage of air from the port weakens the restoring force of the back volume and reduces the diaphragm excursion, preventing the distortion associated with excessive excursion. Ported speakers are sensitive to dimensional errors and their transient responses are inferior to those of sealed speakers. They may be used in conjunction with sealed speakers to boost attenuated bass frequencies, or they may be adjusted to get the highest sound level out of small speaker for limited-frequency applications such as alarms and audible status signals.

Premium sound quality at venues and in vehicles was historically associated with large, multi-cone speakers built into commensurately large cabinets. The back volume of a sealed or ported speaker functions as an acoustic resonant chamber. Airtight sealing improves the mechanical Q, factor, a dimensionless value associated with underdamping and the suppression of frequency spreading. A definition of mechanical Q based on a single damped mass-spring system is:

$$Q = \frac{\sqrt{Mk}}{D},$$

where M is the mass, k is the spring constant, and D is the damping coefficient proportional to the damping force and inversely proportional to the velocity of the oscillating mass.

FIGS. 1A-ID illustrate a few examples of miniature speakers. In FIG. 1A, an example of a cut-away side view of a speaker omits the basket that may cover the back components, showing permanent magnet 101, cut ends 102 of the voice coil, diaphragm 103.1, and edge frame 104.1.

Figure 1B:
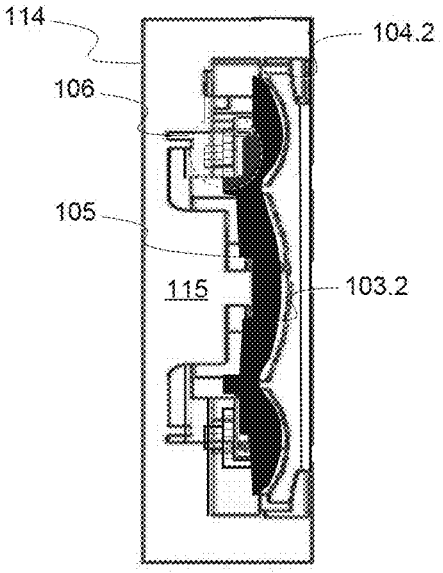
FIG. 1B (Prior Art)

FIG. 1B is a side cut-away view of an example of a cased speaker showing diaphragm 103.2, edge frame 104.2, and vents 106 that connect the air-space 105 just behind diaphragm 103.2 to the air-space 115 created by the casing 114 to create a single, unified back volume.

Figure 1C:
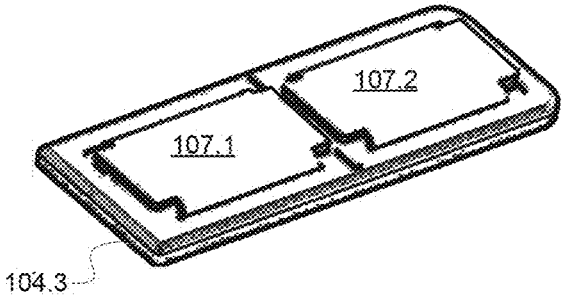
Figure 1D:
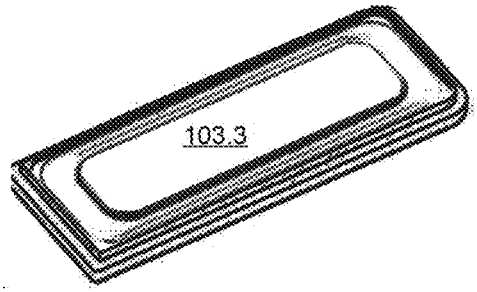

FIG. 1C is a back perspective view and FIG. 1D is a front perspective view of an example of miniature rectangular speaker. Visible are the frame 104.3, a single front diaphragm 103.3, and dual baskets 107.1 and 107.2. Each basket 107.1 or 107.2 covers a permanent magnet and moving voice coil. Accordingly, FIG. 1C and FIG. 1D illustrate a monolithic speaker with dual voice coils. Some rectangular speakers may alternatively have single voice coils like their circular counterparts.

FIGS. 2A-2E illustrate various speakers with double-walled and single-walled enclosures.

Figure 2A:
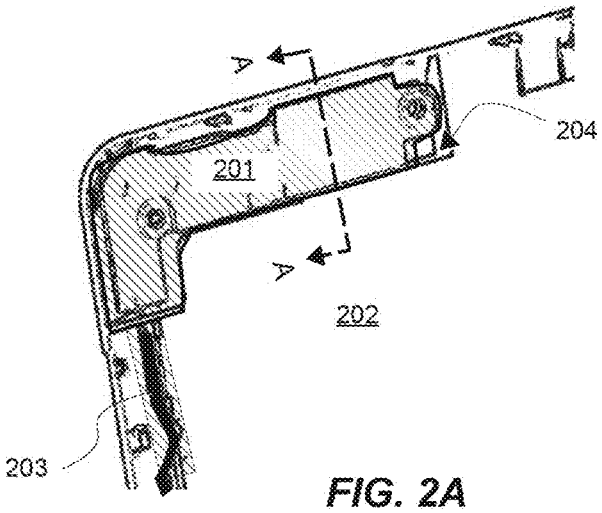
FIG. 2A (Prior Art)
FIGS. 2A-2E illustrate various speakers with double-walled and single-walled enclosures.

In FIG. 2A, a conventional speaker is sealed in a case 201 with signal lines 203 coming out of case 201 to connect to a signal source (not shown). Case 201 may have a placement 204 on or in a parent-device wall 202. Placement 204 may be a cavity, channel, or niche as illustrated. Alternatively, placement 204 may be a designated area on a planar surface of parent-device wall 202, optionally with features that locate, orient, or fasten case 201. Parent-device wall 202 may be structural, such as a chassis, or non-structural, such as a skin or cowling.

Figure 2B:
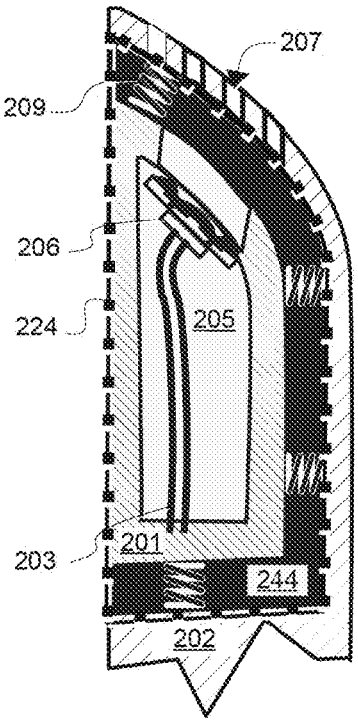
FIG. 2B (Prior Art)

FIG. 2B is an illustration representing a sectional view of the double-walled speaker enclosure through section A-A in FIG. 2A. Dotted outline 224 delineates the boundary of the placement. Speaker 206 has a back volume 205 determined by the interior dimensions of case 201, which is sealed around speaker 206 and its emerging signal lines 203. Case 201 may fit within the placement boundary 224, leaving a surrounding empty space or gap 244 for vibration-damping material, represented in the illustration by springs 209. For example, vibration damping 209 may include an elastomer sheet or distributed elastomer standoffs, an elastically deformable foam, or an adhesive such as RTV that remains elastically compliant after curing. Without vibration damping, case 201 and parent-device wall 202 might rattle or buzz at resonant frequencies. Holes 207 in parent-device wall 202 form a grill for the speaker.

In this example, the size of speaker 206 and its back volume 205 is limited by requiring case 201 and vibration damping 209 inside placement boundary 224. Even if the wall thickness of case 201 and the vibration-damping gap 244 are on the order of a few millimeters or several tenths of a millimeter, these thicknesses may become more and more significant as overall speaker size decreases.

Figure 2C:
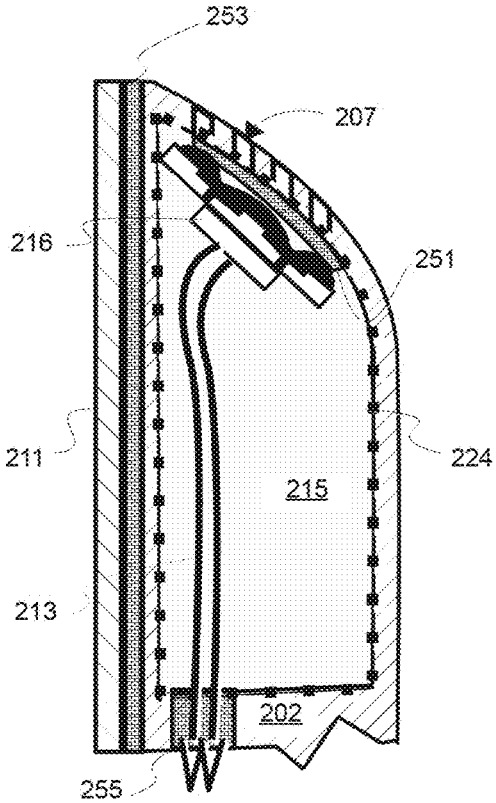

FIG. 2C is an illustration representing a sectional view, comparable to FIG. 2B, of an uncased audio speaker in a single-walled speaker enclosure. Parent-device wall 202 outside placement boundary 224 forms part of the single enclosure wall which allows the use of an uncased audio speaker 216 having a greater diameter than cased speaker 206 in FIG. 2B. Similarly, the back volume 215, sealed by speaker cover 211, includes most of the space inside placement boundary 224. This volume is significantly larger than back volume 205 in FIG. 2B.

In some embodiments, speaker 216 is sealed by speaker seal 251 to parent-device wall 202 near integrated grill 207, and signal-line seal 255 seals around speaker signal lines 213 where they exit back volume 215. In some embodiments, wall seal 253 may form an airtight seal between speaker cover 211 and parent-device wall 202. If speaker 216 is to be ported, the port may be placed in one of the seals 251, 253, or 255; in a part of the parent-device wall; or in speaker cover 211. In some embodiments, one or more of the seals 251, 253, and 255 is elastically resilient to tension, compression, or both. The seal material may be, e.g., an elastomer gasket or O-ring, or a polymer or epoxy applied in liquid form and allowed to cure. Because there is only one wall around the speaker, vibration damping may not be needed.

Figure 2D:
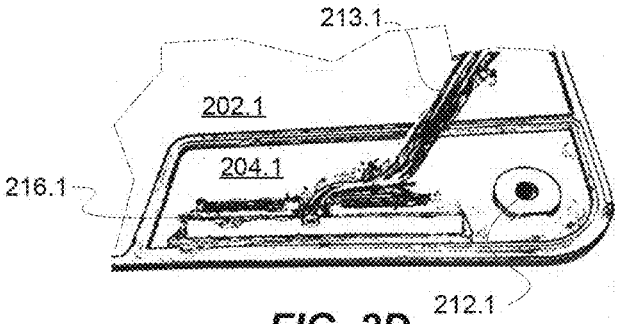

FIG. 2D is an example of a digital speaker in the speaker placement of a parent-device wall. Dual-coil rectangular digital speaker 216.1 is larger than the largest double-walled speaker, such as 206 in FIG. 2B, that could fit in placement 204.1 of parent-device wall 202.1. Digital-signal lines 213.1 connect speaker 216.1 to a signal source. Existing features such as locating/fastening feature 212.1 may be used to locate or attach a speaker cover (not shown in this view).

Figure 2E:
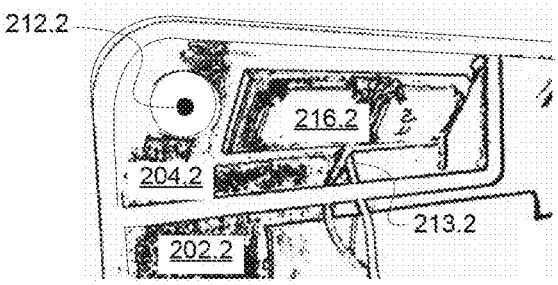

FIG. 2E is an example of an analog speaker in the speaker placement of a parent-device wall. Dual-coil rectangular analog speaker 216.2 is larger than the largest double-walled speaker, such as 206 in FIG. 2B, that could fit in placement 204.2 of parent-device wall 202.2. Analog-signal lines 213.2 connect speaker 216.2 to an analog signal source. Existing locating/fastening features such as 212.2 may be used to locate or attach a speaker cover (not shown in this view).

FIGS. 3A-3E are perspective views of single-walled enclosures incorporating the parent-device wall.

Figure 3A:
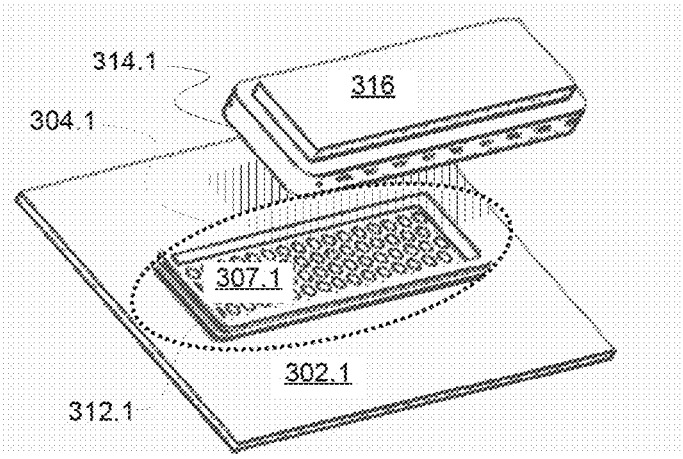
FIGS. 3A-3E are perspective views of single-walled enclosures incorporating the parent-device wall.

In FIG. 3A, speaker placement 304.1 in parent-device wall 302.1 is simply a grill 307.1 with a raised lip 312.1 as a locating or fastening feature. For example, raised lip 312.1 may include a groove around the outer or inner perimeter for an O-ring, a seat for a gasket, a groove around the top perimeter for adhesive, or a snap-locking latch. Miniature speaker 316 may have a complementary feature on its frame 314.1 configured to mate with a feature on raised lip 312.1.

Figure 3B:
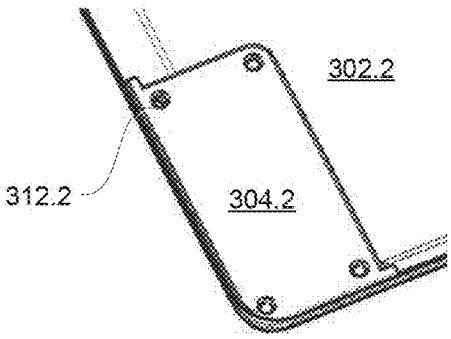

In FIG. 3B, speaker placement 304.2 in parent-device wall 302.2 is flat, but recessed. Locating/fastening features 312.2 may be for locating pins, fasteners, an injectable adhesive, or the like.

Figure 3C:
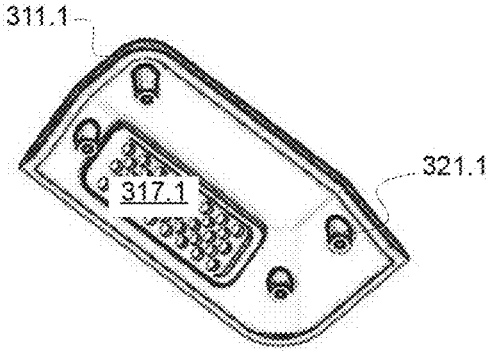

FIG. 3C is a multi-sided speaker cover for use when the parent-device wall contributes less than 5 sides of the single-walled enclosure. Speaker cover 311.1 includes grill 317.1, and in various embodiments, the grill may be part of the speaker cover, part of the parent-device wall, both, or neither. Locating or fastening features 321.1 may be complementary to a feature pattern similar to 312.2 in FIG. 3B.

Figure 3E:
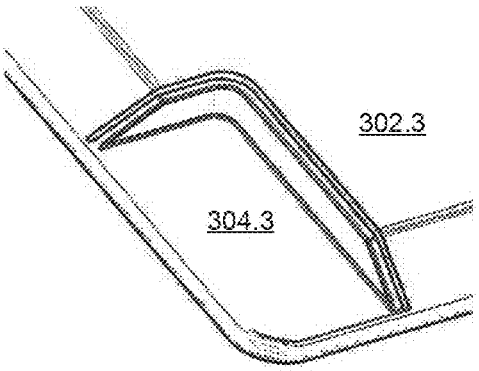
Figure 3D:
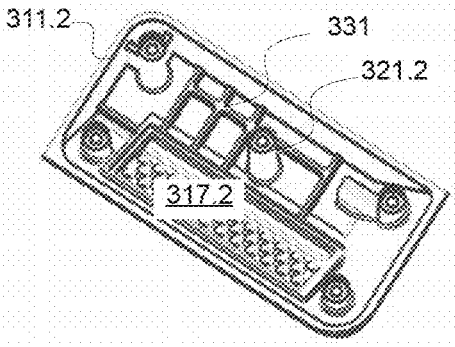

FIG. 3D is another multi-sided speaker cover 311.2 including a grill 317.2, structural ribbing 331, and locating/fastening features 321.2.

In FIG. 3E, placement 304.3 in parent-device wall 302.3 contributes three sides to the single-walled enclosure, leaving the other 3 sides to be provided by the speaker cover. In an N-sided single-walled enclosure, the parent-device wall may constitute between 1 and N−1 sides. For example, a 6-sided single-walled enclosure may use 1 to 5 surfaces of the parent-device wall, with the speaker making up the rest. Shared sides, where a side of the single-walled enclosure is partly parent-device wall and partly a section of speaker-cover wall that continues the same plane or contour, are also contemplated.

For a sealed back volume, or one with precisely controlled porting, the speaker perimeter may not be the only place to use an airtight seal. Signal lines passing from the single-walled enclosure to a signal source outside the enclosure may need to be sealed where they exit the enclosure.

Figure 4A:
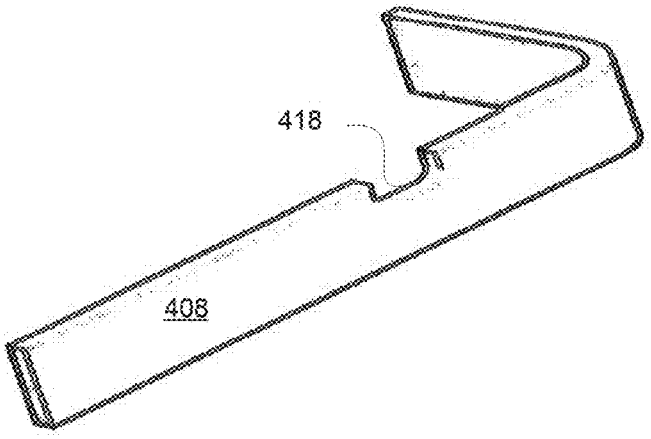
FIGS. 4A-4B illustrate aspects of sealed signal lines.
Figure 4B:
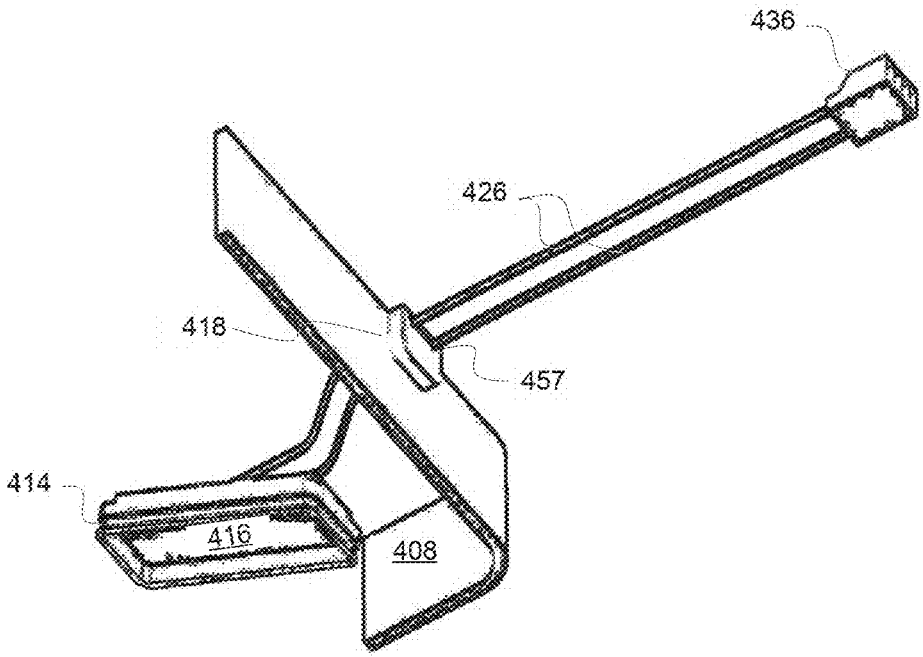

FIGS. 4A-4B illustrate aspects of sealed signal lines.

FIG. 4A is a perspective view of an exemplary bracket for sealing signal lines. Bracket 408 includes a notch 418 in one edge.

FIG. 4B is a perspective view of an exemplary bracket with signal lines sealed in. Signal lines 426 of speaker 416 are held in seal 457, which is inserted in notch 418 of bracket 408. Seal 457 may be an elastomer or other elastically compressible material. As illustrated, signal lines 426 terminate outside bracket 408 at signal connector 436. Sufficient length of signal lines 426 may be reserved inside bracket 408 for frame 414 of speaker 416 to easily reach its placement on the parent-device wall or speaker cover (not shown in this view).

Figure 5:
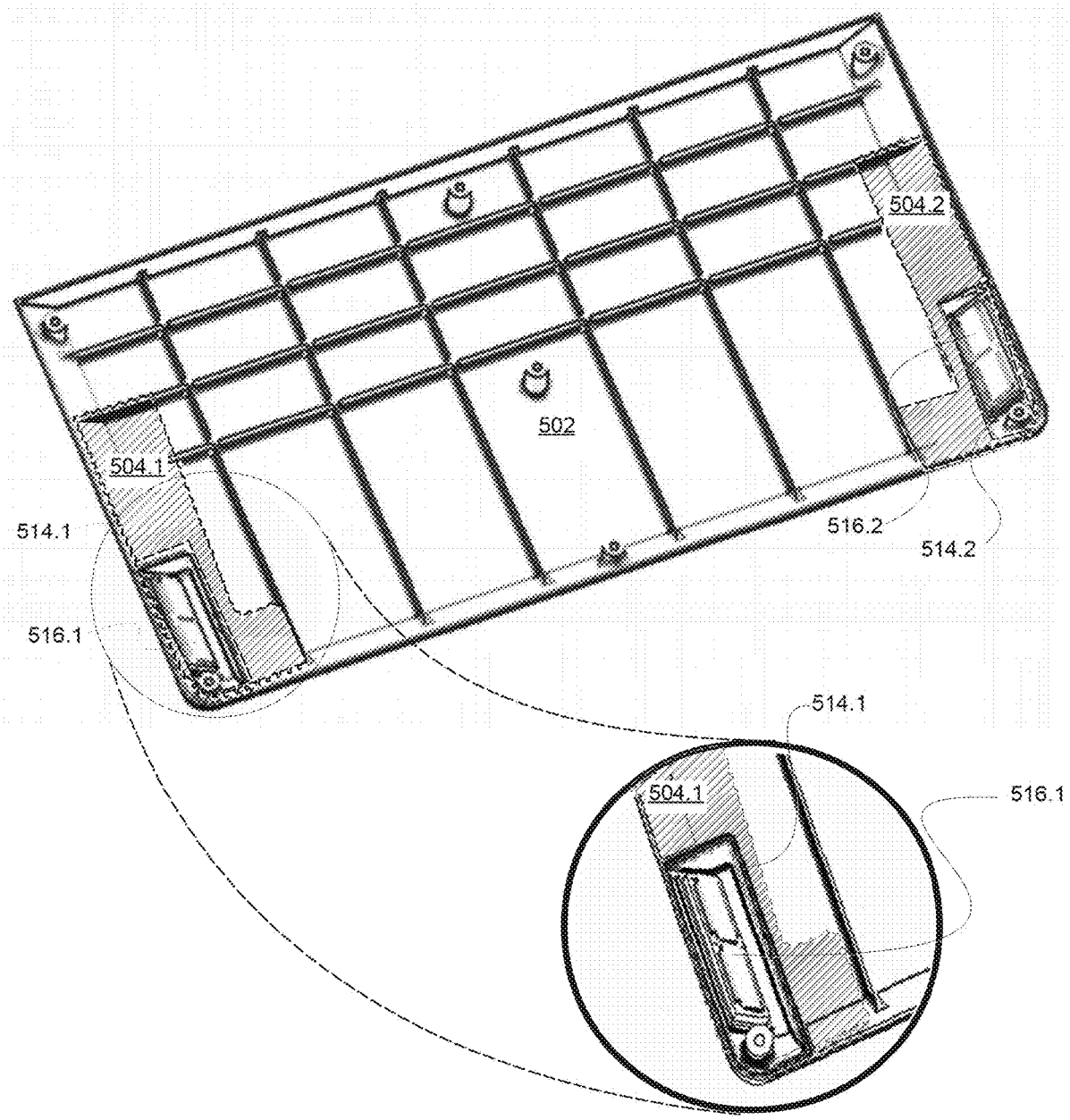
FIG. 5 illustrates an example of retrofitting uncased audio speakers in an existing chassis designed for cased speakers.

FIG. 5 illustrates an example of retrofitting uncased audio speakers in an existing chassis designed for cased speakers. Existing chassis 502 has various ribs and placements for various components. Other parent-device walls may include vents, heat-sinks, latches, hinges, and other features. A complex custom parent-device wall may be expensive to retool when an interior component of the parent device is changed. However, speaker placements 504.1 and 504.2 designed for cased speakers readily accommodate uncased speakers 516.1 and 516.2 without needing modification.

Speaker covers and seals to provide the remaining sides of a single-walled enclosure would be significantly smaller and simpler to have made than a customized chassis. On the other hand, a future version of chassis 502 could be designed with smaller placements 514.1 and 514.2 and accordingly sized speaker covers (not shown in this view) specifically tailored for uncased speakers, potentially simplifying the speaker placement and speaker cover (rectangular rather than L-shaped) and freeing up space for other interior components.

FIGS. 6A-6D illustrate conventional glue-in speakers.

Figure 6A:
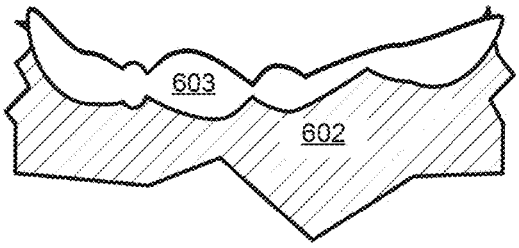
FIG. 6A (Prior Art)
FIGS. 6A-6D illustrate conventional glue-in speakers.

FIG. 6A is a top view of wall 602 near the speaker aperture. Adhesive 603 is applied around the perimeter of the speaker aperture in wall 602. Adhesive 603 may be applied as a liquid or as a double-sided adhesive strip.

Figure 6B:
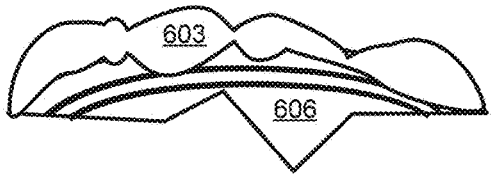
FIG. 6B (Prior Art)

FIG. 6B is a view of the front face of speaker 606 that will be sealed to the speaker aperture. Adhesive 603 is applied around the perimeter of the front of speaker 606. This is an alternative to the adhesive placement of FIG. 6A that might be used, for example, if the speaker aperture were difficult to reach or close to other components that might be harmed by stray drops of adhesive.

Figure 6C:
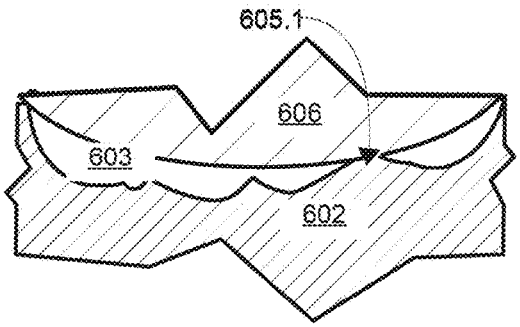
FIG. 6C (Prior Art)

FIG. 6C is a top view of a speaker 606 pushed against aperture wall 602 through adhesive 603. Speaker 606 is placed face-down over the aperture in wall 602 with the adhesive 603 dispersed between them. Apparent coverage gap 605.1 might be filled in under speaker 606 so that it does not actually affect the seal. On the other hand, the air gap may persist all the way through the line of adhesive 603, in which case the speaker sound will be degraded. A visual inspection from this angle is inconclusive. There is both a risk of wasting more effort on a faulty speaker assembly and a risk of rejecting a speaker that would have been satisfactory.

Figure 6D:
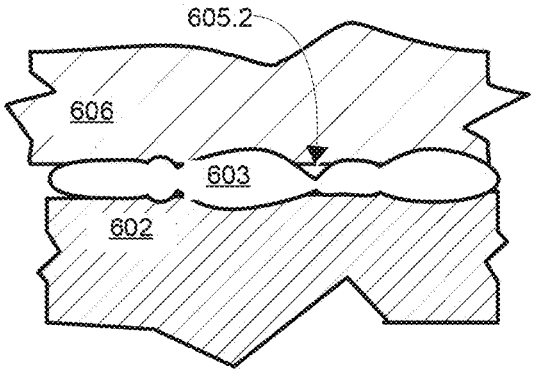
FIG. 6D (Prior Art)

FIG. 6D is a side view of the assembly from FIG. 6C. Looking at the seal from the side, gap 605.2 is evident. This gap will probably leak air from the back volume out into the surrounding environment, reducing the mechanical Q of the speaker assembly and negatively affecting its sound. Depending on the design of the part that includes wall 602, a side view like this may be challenging to obtain.

Besides consistency and repeatability challenges, the use of adhesives may increase inventory overhead because of the need to use it before it expires. Some adhesives give off toxic fumes and vapors as they cure, requiring safety precautions. Finally, adhesive application and curing is often done as a batch process; this may slow down manufacturing if the rest of the processes are continuous processes.

FIGS. 7A-7H illustrate examples of seals for the fronts of audio speakers that do not necessarily include adhesive.

Figure 7A:
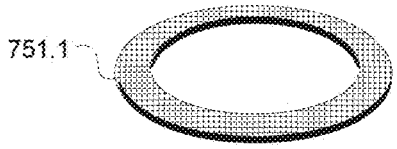
FIGS. 7A-7H illustrate examples of seals for the fronts of audio speakers that do not necessarily include adhesive.
Figure 7B:
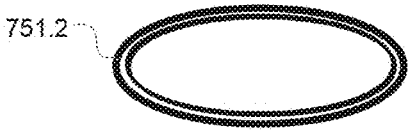

FIG. 7A represents a gasket 751.1 and FIG. 7B represents an O-ring 751.2. When made of material that is mechanically resilient to compression, and compressed by surrounding structures, gasket 751.1 and O-ring 751.2 may serve as resilient layers providing the desired air-tight seal.

Figure 7C:
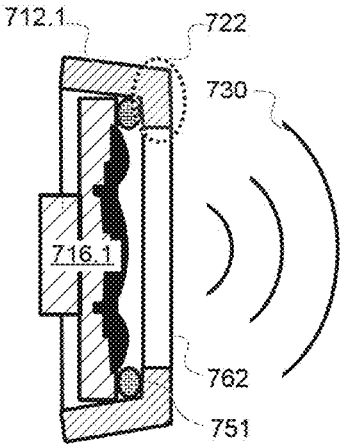
Figure 7D:
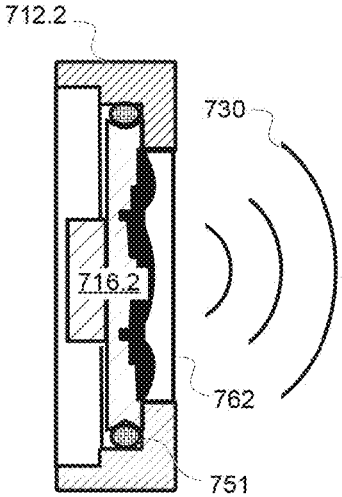
Figure 7E:
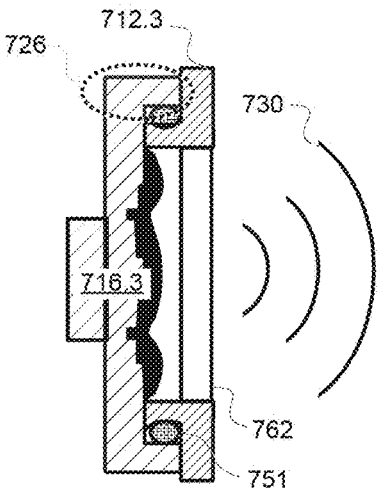

FIGS. 7C-7E represent examples of different configurations of O-rings or other resilient layers for use in speaker assemblies.

In FIG. 7C, resilient layer 751 seals the front rim of the frame of speaker 716.1. Speaker aperture 762, the parent device's output for speaker sound 730, is surrounded by a shoulder 722 wide enough for resilient layer 751 to contact the frame edge without interfering with the diaphragm motion of speaker 716.1.

In FIG. 7D, resilient layer 751 seals the side of the frame of speaker 716.2 to the inside wall of a counterbore in wall 712.2 surrounding speaker aperture 762, the parent device's output for audio signals 730. Optionally, the speaker frame rim, the counterbore, or both may have features, such as grooves, to hold resilient layer 751 in position.

In FIG. 7E, resilient layer 751 seals a flange 726 extending out around the front rim of the frame of speaker 716.3 to a raised ridge in wall 712.3 surrounding speaker aperture 762, the parent device's output 1 for audio signals 730.

Figure 7F:
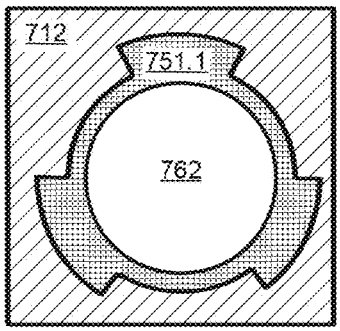
Figure 7G:
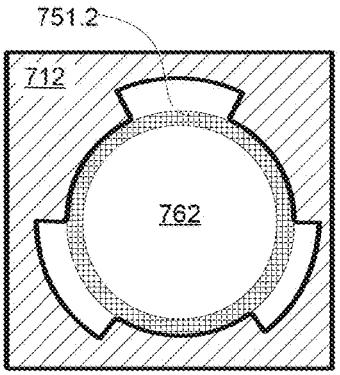
Figure 7H:
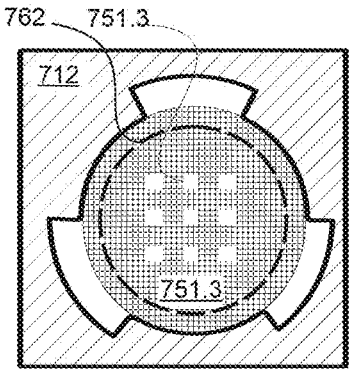

FIGS. 7F-7H represent examples of different configurations of gaskets or other resilient layers in speaker assemblies.

Resilient layer 751.1 or 751.2 in wall 712 may have an aperture 762 approximately matching the speaker aperture to expose the diaphragm or other front speaker surface, as in FIGS. 7F and 7G. Resilient layer 751.1 in FIG. 7F may cover the entire shoulder around speaker aperture 762. By contrast, resilient layer 751.2 in FIG. 7G may cover only part of the shoulder around speaker aperture 762. Alternatively, as illustrated in FIG. 7H, resilient layer 751.3 may cover the aperture 762, with the center region forming a grill, e.g., by perforations 751.3.

Figure 8A:
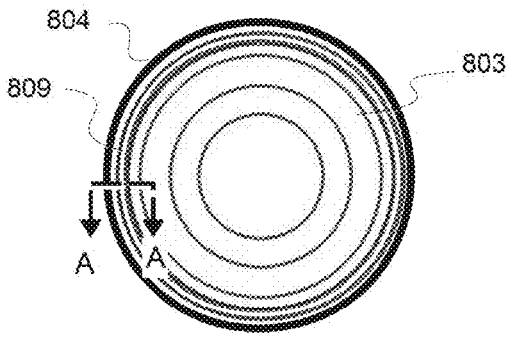
FIGS. 8A-8B illustrate a top view and a cross-sectional view of a speaker with an integral, "flangeless" front seal.
Figure 8B:
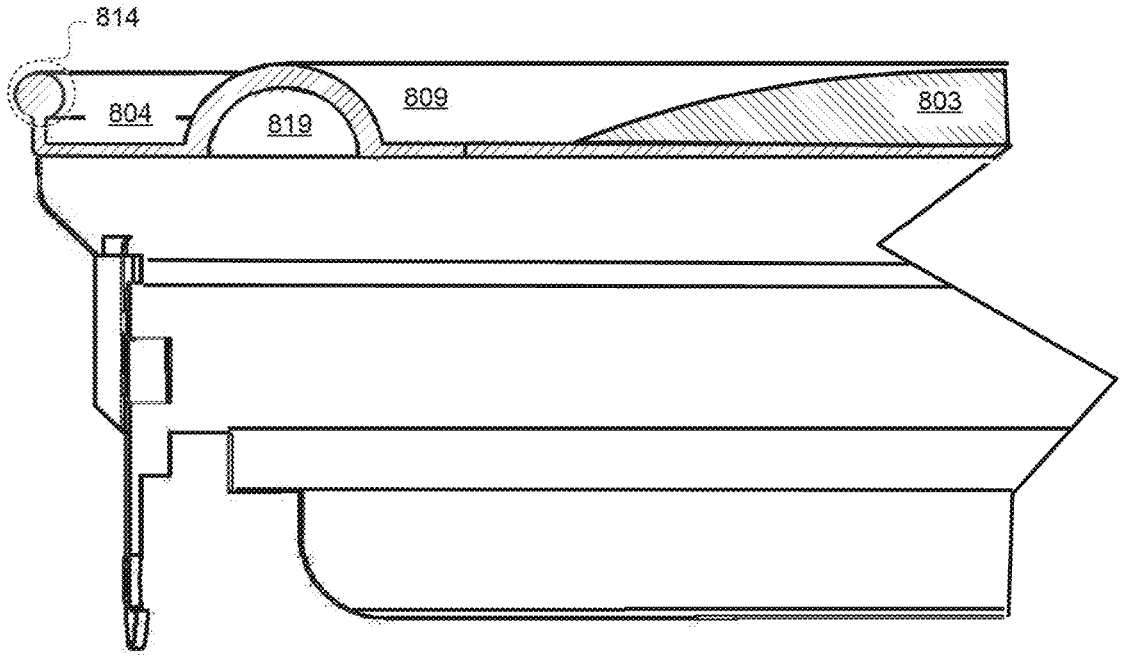

FIGS. 8A-8B illustrate a top view and a cross-sectional view of a speaker with an integral, "flangeless" front seal. The front of the speaker includes an integrated resilient section on the front of the speaker near the rim of the frame, alleviating the need for a gasket, O-ring, or other extra part to make the front seal. When the speaker is assembled into an enclosure, part of the enclosure is intended to compress the integral seal, and the integral seal is intended to provide a restoring force that maintains a substantially air-tight seal and, optionally, may also cushion the speaker from external shock or vibration.

FIG. 8A is a top view of a speaker with an integral seal. Although the example relates to a round speaker, any other suitable shape may be substituted (e.g., rectangular). Frame 804 around the perimeter, integral seal 809, and the outer lobe of diaphragm 803 are referenced.

FIG. 8B is a cross-section through A-A of FIG. 8A. Frame 804 has a bead 814 around the rim 804 that may optionally be used as part of a snap-lock. Integral seal 809 extends beyond the level where rim 804 and a mating part in the speaker enclosure (not shown in this view) meet or overlap. Integral seal 809, like the O-rings and gaskets it replaces, may be compressible and may exert a restoring force against the compression.

As illustrated, integral seal 809 is an annular bump with a rounded cross-section, but any suitable shape may be used. Space 819 inside or under integral seal 809 may be hollow, filled with the same material as integral seal 809, filled with the same material as diaphragm 803 (if diaphragm 803 is made of a different material than integral seal 809), or filled with any other suitable material to produce the desired gasket-like properties. Similarly, integral seal 809 may be made of the same material as frame 804, or the same material as diaphragm 803 (if diaphragm 803 is made of a different material than frame 804), or any other suitable material to produce the desired gasket-like properties. Optionally, frame 804, integral seal 809, and diaphragm 803 may be fabricated as a single piece.

FIGS. 9A-9D illustrate an attachment of a speaker to a speaker-aperture wall with overlapping-tab pairs. The speaker has a first set of tabs, the speaker-aperture vicinity of the wall has a second set of tabs, and the attachment is based on sliding one set over or under the other until they at least partially overlap. Snap-fit, stiction, or any other suitable method may be used to keep the tabs in place, thus keeping the parts joined. A material that is elastically resilient to compression (e.g., certain elastomers) forms a seal between the parts and prevents rattling. For a sealed speaker, the resilient material may preferably be nonporous. For a ported speaker, the resilient material may be porous enough to pass the amount of air prescribed for the port.

Figure 9A:
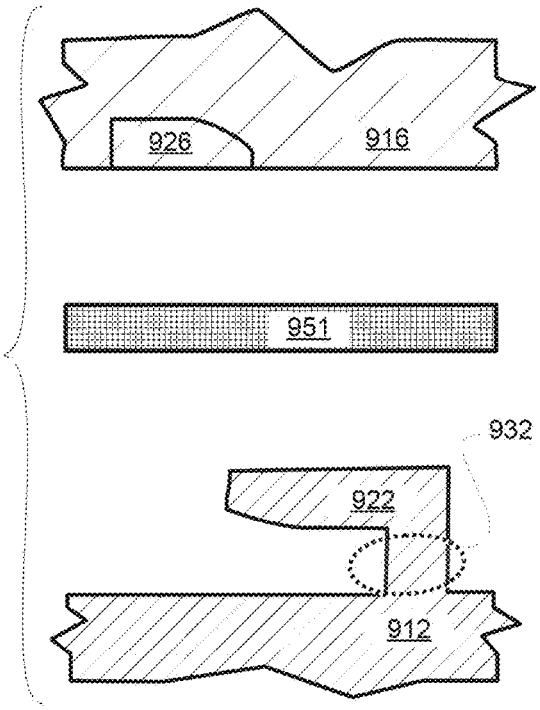
FIGS. 9A-9D illustrate an attachment of a speaker to a speaker-aperture wall with overlapping-tab pairs.

FIG. 9A is an exploded cross-sectional view of wall 912 near, but not intersecting, the speaker aperture (see section A-A in FIG. 10A) showing a wall tab 922 raised above the top of wall 912 by wall tab standoff 932; speaker 916 (face-down in this view) and speaker tab 926; and resilient layer 951 between the two. In some embodiments, resilient layer 951 may be built onto the perimeter or front of speaker 916 at the time of speaker manufacture.

Figure 9B:
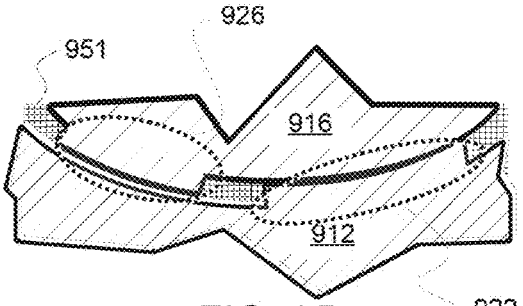

FIG. 9B is a top view of the speaker, resilient layer, and wall preliminary to assembly. Although a round-shaped speaker is illustrated, the sliding-tab approach may also be adapted for rectangular and other geometries. Wall 912 has wall tabs 922 raised above an aperture shoulder and spaced at intervals. The intervals between wall tabs 922 are large enough to accommodate speaker tabs 926 extending out from speaker 916. Resilient layer 951 covers at least the part of the aperture shoulder that contacts the front perimeter of speaker 916.

Figure 9C:
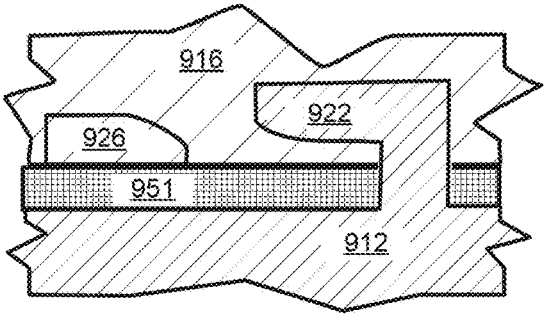

FIG. 9C is a cutaway side view of the assembly shown in FIG. 9B. With the parts simply laid over one another and resilient layer 951 uncompressed, wall tab 922 does not appear to have sufficient clearance for speaker tab 926 extending from speaker 916.

Figure 9D:
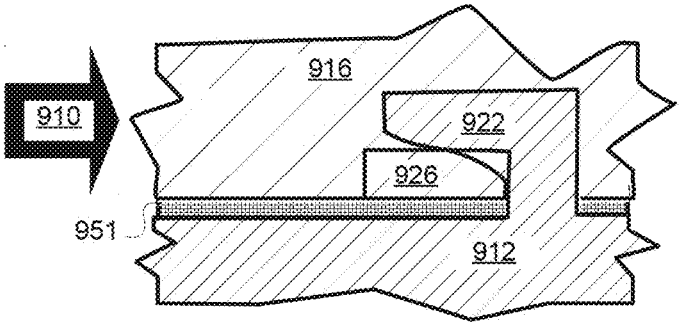

FIG. 9D is the same assembly with the tabs engaged. The speaker was moved (in the case of the illustrated round speaker, rotated) in direction 910 relative to wall 912. To make room for speaker tab 926 under wall tab 922, resilient layer 951 is compressed. The compression enables resilient layer 951 to provide (1) a tight seal to confine air in the back volume and (2) a restoring force to stabilize the joint. As illustrated, speaker tab 926 and wall tab 922 have a plane contact, held together by the restoring force of compressed resilient layer 951 and by stiction between the two contacting surfaces. Stiction can be enhanced by roughening the contacting surfaces to, e.g., an rms roughness of 0.05-0.3 mm.

The restoring force from compressed resilient layer 951 pushes speaker 916 upward, Wall tab 922 exerts a downward counterforce on the underlying portion of speaker tab 926. As a result, speaker tabs 926 may be subject to shear stress at the inner edge of the overlap where the downward counterforce ends, as well as compressive stress within the overlap zone. In some embodiments, speaker tabs 926 are as resistant to damage by shear and compression, at least within an order of magnitude, as the outer frame or basket of speaker 916.

FIGS. 10A-G illustrate more views and examples of sliding-tab sealing assemblies.

Figure 10A:
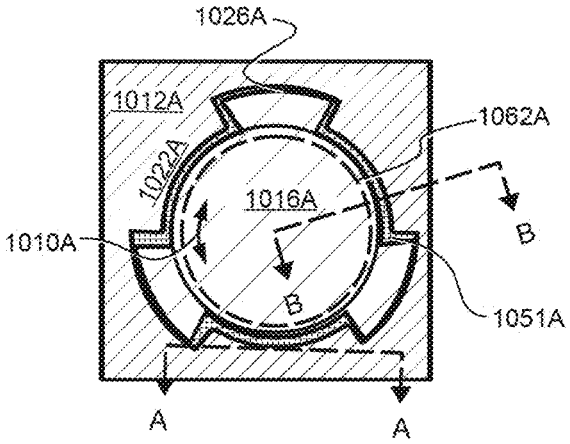
FIGS. 10A-G illustrate more views and examples of sliding-tab sealing assemblies.

FIG. 10A is a top view of sliding-tab seal parts for a circular audio speaker. Wall 1012A includes wall tabs 1022A. Between wall tabs 1022A are cutouts to accommodate speaker tabs 1026A, which extend out from speaker 1016A. Between speaker 1016A and wall 1012A is resilient layer 1051A. Resilient layer 1051A and speaker 1016A rest on a ring-shaped shoulder recessed into wall 1012A and surrounding speaker aperture 1062A by which the sound from the speaker exits the parent device. In this view, the hidden line defines the edge of speaker aperture 1062A. To seal speaker 1016A to wall 1012A, speaker 1016A is rotated in one of motion directions 1010A to slide (and optionally lock) speaker tabs 1026A under wall tabs 1022A. Section A-A roughly corresponds to the views in FIGS. 9A, C, and D: along a roughly tangential line that does not intersect speaker aperture 1062A. Section B-B roughly corresponds to the view in FIG. 10C: along a roughly radial line that does intersect speaker aperture 1062A.

Figure 10B:
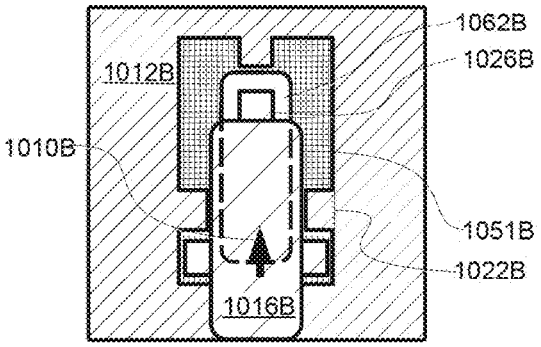

FIG. 10B is a top view of sliding-tab seal parts for a rectangular audio speaker. Wall 1012B includes wall tabs 1022B. Between wall tabs 1022B are spaces to accommodate speaker tabs 1026B, which extend out from speaker 1016B. Between speaker 1016B and wall 1012B is resilient layer 1051B. Resilient layer 1051B and speaker 1016B rest on a rectangular shoulder recessed into wall 1012B and surrounding speaker aperture 1062B by which the sound from the speaker exits the parent device. In this view, some of speaker aperture 1062B is visible because speaker 1016B has not yet been slid into place/To seal speaker 1016B to wall 1012B, speaker 1016B is pushed or pulled in motion direction 1010B to slide (and optionally lock) speaker tabs 1026B under wall tabs 1022B.

Figure 10C:
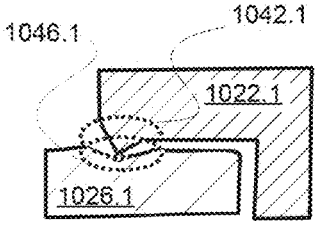
Figure 10D:
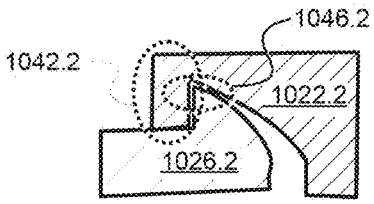
Figure 10E:
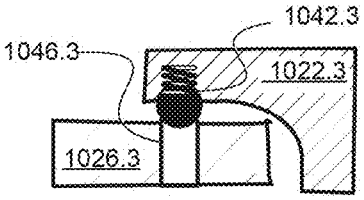

FIGS. 10C-10E are cross-sections through either A-A or B-B of FIG. 10A, illustrating different snap-locking designs. The snap-lock added to the sliding tabs holds the tabs in place, allowing looser tolerances than a friction fit, and provides an audible or tactile "click," which may be sensed by human or some robotic assemblers, when the tabs are overlapped and locked correctly.

In FIG. 10C, wall tab 1022.1 has an approximately conical bump 1042.1. Speaker tab 1026.1 has a complementary recess 1046.1 into which conical bump 1042.1 clicks. The same cross-section also represents an embodiment in which 1042.1 is a V-shaped ridge extending in and out of the page and 1046.1 is a corresponding parallel groove.

In FIG. 10D, wall tab 1022.2 has a downward-extending latch 1042.2. Speaker tab 1026.2 has a complementary upward-extending latch 1046.2 into which downward-extending latch 1042.2 clicks.

In FIG. 10E, wall tab 1022.3 has a spherical bump 1042.3. As illustrated, spherical bump 1042.3 is spring-loaded, but the spring may be omitted if the resiliency of the resilient layer (not shown in this view) is high enough to make the spring unnecessary. Speaker tab 1026.3 has a complementary hole 1046.3 into which spherical bump 1042.3 clicks.

Figure 10F:
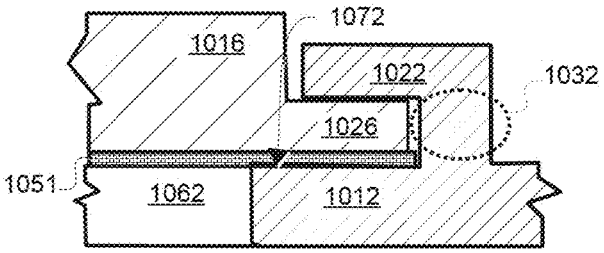

FIG. 10F is a sectional view through section B-B of FIG. 10A illustrating another way to arrange the wall tabs. In FIGS. 9A-D, the leading edge of speaker tab 926 slides toward wall tab standoff 932 when the speaker is rotated or translated in the locking direction. In FIG. 10F, the leading edge of speaker tab 926 slides past wall tab standoff 1032 when the speaker is rotated or translated in the locking direction. As illustrated, speaker 1016 is rotated relative to wall 1012 to slide speaker tab 1026 under wall tab 1022. Speaker aperture 1062 and wall shoulder 1072 are visible in this view.

Figure 10G:
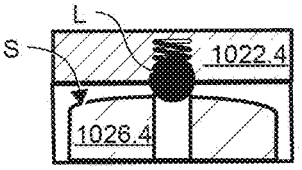

FIG. 10G is an illustration of an embodiment of the ball-and-hole latch of FIG. 10E through section A-A of FIG. 10A. Top surface S of speaker tab 1026.4 may be tapered in one or more places that may become leading edge(s) for the sliding tabs, to make it smoother and easier to slide speaker tab 1026.4 under the latch portion of wall tab 1022.4. Although the illustration shows a ball-and-hole latch, the technique may also be used with other latch designs.

FIGS. 11A-11D are perspective views of examples of tabbed speaker parts and assemblies.

Figure 11A:
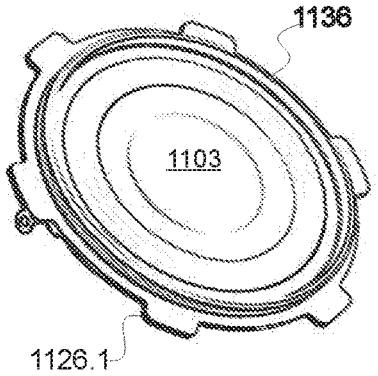
FIGS. 11A-11D are perspective views of examples of tabbed speaker parts and assemblies.

FIG. 11A is a perspective view of a tabbed integrated front piece of a round speaker. The single piece includes diaphragm 1103, speaker tab 1126.1, and ridge 1136 that may be used to position the opening of a gasket or O-ring.

Figure 11B:
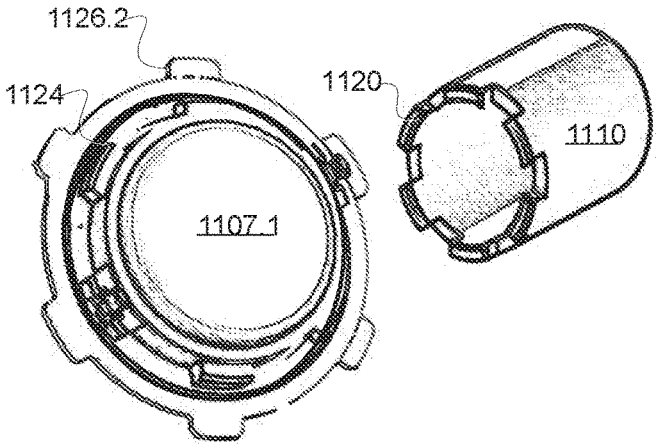

FIG. 11B is a perspective view of the back of a tabbed round speaker. Around the edges of basket 1107.1 are speaker cog teeth 1124. Installation tool 1110 has complementary tool cog teeth 1120. The tabbed speaker can be installed from the back, either manually or automatically, by meshing tool cog teeth 1120 with speaker cog teeth 1124, pushing down to compress the gasket, O-ring, or other resilient layer (not shown in this view), and twisting to move speaker tabs 1126.2 under the corresponding wall tabs (not shown in this view).

As illustrated, the speaker has the same number of cog teeth 1124 as speaker tab 1126.2, and cog teeth 1124 are aligned to speaker tab 1126.2. Neither of these is necessary for the general approach to function; the numbers may be different, and the alignment is arbitrary.

Figure 11C:
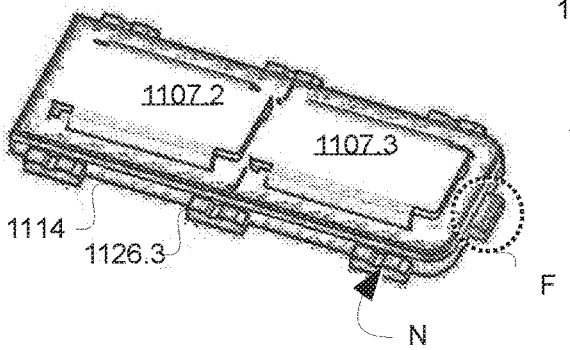

FIG. 11C is a perspective view of the back of a tabbed rectangular speaker. Speaker tabs 1126.3 extending out from frame 1114 have notches N for a clicking feedback when speaker tab 1126.3 are slid under the corresponding wall tabs (not shown in this view) to the desired position. Front tab F (for the explanation of this figure, "front" is temporarily redefined as "the direction in which the speaker slides into place") is optional for some embodiments.

Alternatively, the speaker could be positioned by a click-notch in front tab F, with the side tabs having a smooth top surface. That notch may be oriented in the same absolute direction as notches N, which would make it a lengthwise notch in tab F, compared to crosswise notches N in the side tabs.

A tool analogous to tool 1110 in FIG. 11B could be used to install the speaker of FIG. 11C by meshing with the corner cutouts of baskets 1107.2 and 1107.3, pushing down to compress the resilient layer (not shown in this view), and sliding the speaker in a straight line rather than rotating it.

Figure 11D:
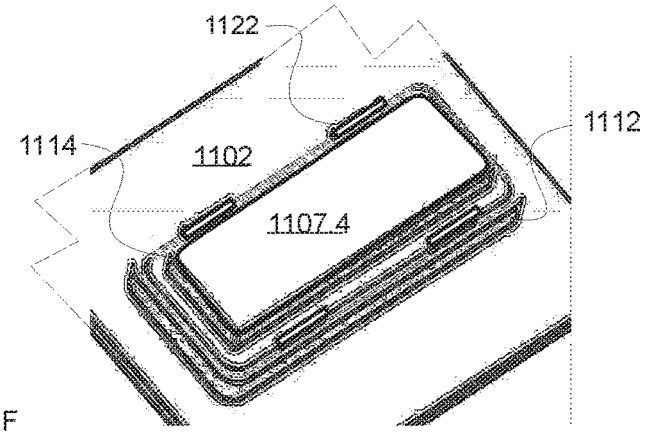

FIG. 11D is a perspective view of the back of an installed rectangular speaker on a parent-device wall 1102. The speaker in this example has a single basket 1107.4. Clamp tabs 1122 extend from raised lip 1112 to grasp and hold the edges of frame 1114.

Materials for speaker covers, frames, and baskets include hard, rigid plastics and lightweight metals such as aluminum and magnesium. Materials for resilient layers include elastomers and other elastically compressible materials.

The preceding Description and accompanying Drawings describe examples of embodiments in some detail to aid understanding. However, the scope of protection may also include equivalents, permutations, and combinations that are not explicitly described herein. Only the appended claims (along with those of parent, child, or divisional patents, if any) define the limits of the protected intellectual-property rights.

We claim:

1. A device, comprising:

a wall;

an audio speaker positioned on a first side of the wall, having a front part defined by a maximum audio output and having at least one non-front part uncovered by the wall;

a speaker aperture through the wall from the first side to a second side, wherein the front of the audio speaker faces the speaker aperture; and a resilient layer between a frame of the audio speaker and a surface of the first side of the wall, wherein the frame of the audio speaker comprises cutouts or cog teeth that extend radially outward from the frame in a plane parallel to the wall and are arranged to be pushed toward the wall and rotated or translated in a plane parallel to the wall, to engage with corresponding wall tabs that extend radially inward from the wall towards the speaker aperture in a plane parallel to the wall on the first side of the wall.

2. The device of claim 1, wherein the resilient layer comprises a gasket.

3. The device of claim 1, wherein the resilient layer comprises an O-ring.

4. The device of claim 1, wherein the resilient layer is airtight.

5. The device of claim 1, wherein the resilient layer is between a front-facing surface of the frame and an opposing surface of the first side of the wall.

6. The device of claim 1, wherein the resilient layer is between an outward-facing surface of the frame and an opposing surface of the first side of the wall.

7. The device of claim 1, wherein the resilient layer is between an inward-facing surface of the frame and an opposing surface of the first side of the wall.

8. The device of claim 1, wherein the resilient layer has an aperture coinciding with the speaker aperture.

9. The device of claim 1, wherein the resilient layer extends across the speaker aperture and comprises a plurality of through-holes inside a perimeter of the speaker aperture.

10. The device of claim 1, wherein the resilient layer is integrated into the front part of the speaker.

11. The device of claim 1, wherein a speaker rim and a speaker diaphragm are made of the same material.

12. The device of claim 1, wherein the resilient layer, the frame, and a speaker diaphragm are formed as a single piece.

13. The device of claim 1, wherein the cutouts or cog teeth are engageable by a tool to be simultaneously pushed and rotated.

14. The device of claim 1, wherein the device further comprises a seal around a signal line of the audio speaker in an opening where the signal line exits the wall.

* * * * *